US005755825A

United States Patent [19]

Kadlecek et al.

[11] Patent Number: 5,755,825

[45] Date of Patent: May 26, 1998

[54] SHARPENER FOR SLITTING BLADE

[75] Inventors: David G. Kadlecek, Phillips; Jeffrey L. Erickson, Medford, both of Wis.

[73] Assignee: Marquip, Inc., Phillips, Wis.

[21] Appl. No.: 736,217

[22] Filed: Oct. 23, 1996

[51] Int. Cl.[6] ..... B24B 19/00

[52] U.S. Cl. ..... 451/419; 451/420; 451/194

[58] Field of Search ..... 451/419, 420, 451/45, 194, 28, 57, 548, 540, 556; 83/174, 174.1

[56] References Cited

U.S. PATENT DOCUMENTS

| | | | |
|---|---|---|---|
| 2,331,157 | 10/1943 | Arey | 451/45 |
| 2,768,486 | 10/1956 | Jones et al. | 451/419 |
| 2,795,255 | 6/1957 | Hansen | 451/45 |
| 2,997,823 | 8/1961 | Dee La Vern Irvin | 451/419 |
| 2,997,824 | 8/1961 | Hansen | 451/419 |
| 3,395,595 | 8/1968 | Braun et al. | 451/419 |
| 4,845,900 | 7/1989 | Suzuki et al. | 451/45 |
| 5,165,314 | 11/1992 | Paulson et al. | 83/174.1 |
| 5,435,771 | 7/1995 | Gregory | 451/45 |

*Primary Examiner*—Timothy V. Eley
*Assistant Examiner*—Derris H. Banks
*Attorney, Agent, or Firm*—Andrus, Sceales, Starke & Sawall

[57] ABSTRACT

A sharpening device for use with a continuous flexible band cutting blade. The sharpening device includes a pair of rotating abrasive wheels positioned on opposite sides of the cutting blade. The rotating wheels are mounted to a pivot plate on either side of a pivot point between the pivot plate and an assembly arm. The pivot plate is rotatable about the pivot point through the application of a pressure device to the pivot plate. By rotating about the pivot point, the pivot plate moves the abrasive wheels into contact with the cutting blade to facilitate sharpening. The assembly arm is fixed about its upstream end, while the downstream end is movable to adjust the position of the abrasive wheels.

18 Claims, 12 Drawing Sheets

FIG. 5
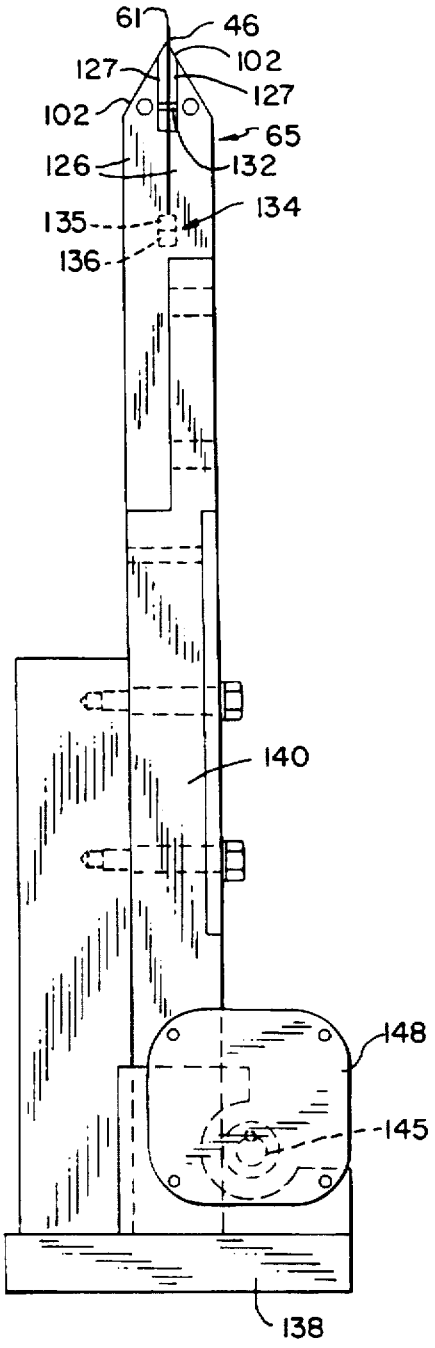
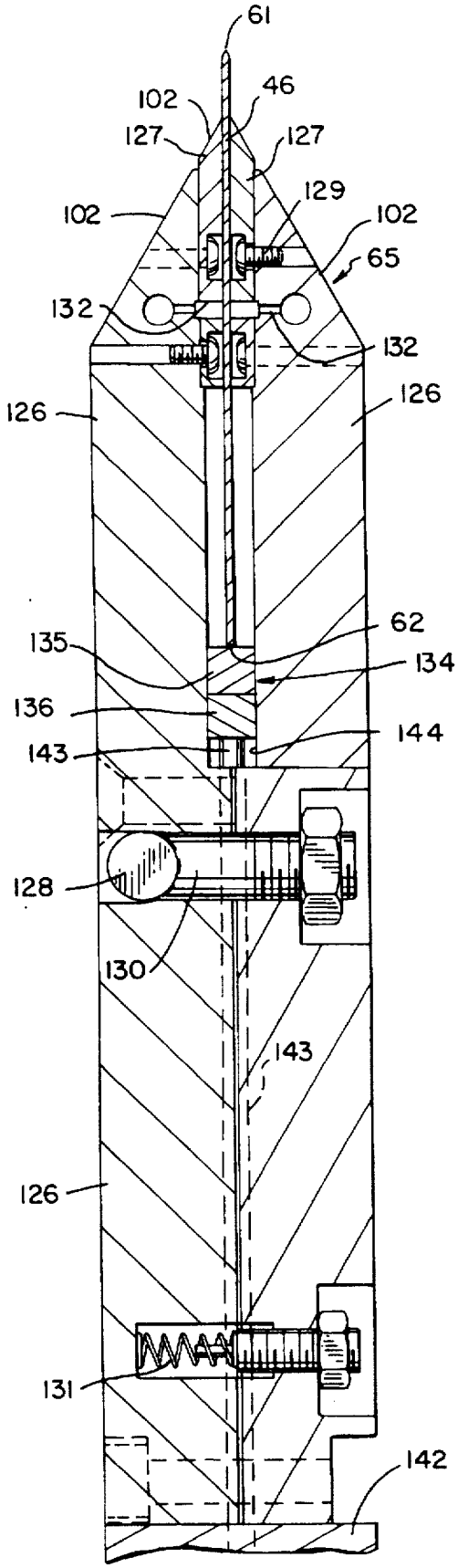
FIG. 6

SHARPENER FOR SLITTING BLADE

CROSS REFERENCE TO RELATED APPLICATION

This application is based on provisional application Ser. No. 60/006,116 filed on Nov. 23, 1995.

BACKGROUND OF THE INVENTION

The present invention relates to slitting stacks of sheet material made of corrugated paperboard and, more particularly, to a sharpening device for a flexible band cutting blade.

Corrugated paperboard box blanks are conventionally printed, folded and glued to form what are referred to as "knocked down boxes" in a flexo-folder-gluer apparatus. This apparatus includes a flexographic printer, a folding mechanism which folds opposite sides of the blank along pre-scored lines, and a gluing device which applies an adhesive along the overlapping edges of the laterally folded sides. The flattened container or knocked down box is thus completely formed and, after the glue dries, the boxes can be stacked and banded for shipment and subsequent assembly. It is known in the art to stack the knocked down boxes exiting the flexo-folder-gluer (hereinafter sometimes referred to as a "flexo") to utilize the stack weight to hold the glued edges together until the glue sets. It is also known in the art to form a shingle of knocked down boxes as they exit from the flexo, also utilizing the weight of the overlapping boxes in the shingle to hold the box position until the adhesive dries.

The knocked down boxes typically assembled in a flexo are of a conventional construction, including four sides, the overlapping edges of two sides of which are glued together on a glue tab, and four slotted end flaps extending integrally from opposite ends of the sides to eventually form the top and bottom closure flaps when the box is subsequently assembled. As indicated, these knocked down boxes are ordinarily finished containers and require no further processing, apart from stacking and banding for shipment. However, it is also known in the art to assemble certain special constructions of knocked down boxes in a flexo, which boxes are subsequently slit into two or more parts to form smaller containers of either a conventional or modified type. For example, it is known to assemble a large regular slotted container (RSC) and subsequently slit the same along a median line to form two half slotted containers, each of which comprises a knocked down container with side walls and bottom flaps or top flaps, but not both. Similarly, a large special regular slotted container can be formed in a flexo in the form of two integrally attached half size regular slotted containers by forming the blank with special double length center slots which, when bisected as the large special RSC is subsequently slit in half perpendicular to the center slots, form the two half-size RSCs.

Although the formation of the foregoing types of large knocked down boxes, which must be subsequently slit for end use, is well known, production of such boxes on a large scale has never been achieved, primarily because of difficulties in slitting them. Corrugated paperboard sheet stock is conventionally slit longitudinally by the use of a pair of upper and lower cooperating slitting blades which operate as a shear-type cutter. It has been found, however, that such dual knife shear cutters do not provide clean cuts with heavy and/or multi-wall corrugated board. Shear-type slitting inherently causes a vertical displacement of the adjacent slit edges of the board and, as the board thickness increases or as multiple layers are slit, the relative vertical displacement becomes larger and a ragged cut edge typically results. The multiple board layers presented by a knocked down box result in the same characteristic ragged cuts when shear-type slitters are used.

In addition, slitting large special containers exiting a flexo-folder-gluer has typically been done as an off-line process. In other words, the large knocked down boxes are taken off the flexo, moved to another location, and slit individually to form two half-size knocked down boxes. Even with this technique, the longitudinal slits are typically less than satisfactory because of the use of shear-type slitting devices. In addition, registration of the boxes, meaning lateral alignment so that the slit is directly on the centerline of the large regular or special slotted container, is difficult to attain with conventional off-line methods in which one box at a time is slit.

Nevertheless, real advantages in production volume and box quality could be attained with an apparatus and method which would slit large regular or special slotted containers to form two half-size containers in an on-line basis. Furthermore, small containers are typically not run on a flexo because small container blanks are extremely difficult to handle, not only in the flexo, but in upstream material handling devices as well. Thus, there is a real need in the industry for a system which can provide for the manufacture of high quality small size knocked down boxes, but will also utilize a flexo-folder-gluer in its most effective and efficient manner.

In one known prior art method, the on-line slitting of knocked down boxes is accomplished by forming a shingle of the boxes as they exit the flexo, unshingling the boxes downstream and feeding them one at a time through a conventional shear-type slitter, and then separately reshingling or stacking each of the series of half-size boxes. However, this process is slow, causes loss of box registration, and still results in ragged slit edges on the boxes.

It is also known to form knocked down boxes from a flexo-folder-gluer into a shingle and to slit the shingle on-line using a single thin high speed rotary slitting blade. Various techniques for slitting corrugated boxes in this manner are shown in U.S. Pat. Nos. 5,158,522 and 5,165,314. The apparatus for slitting such boxes is more broadly described in U.S. Pat. No. 5,090,281. Although high speed slitting with a single rotary slitting blade has improved substantially the quality of cuts, as well as processing speeds, excessive box handling equipment and steps are still required.

In accordance with the invention described in commonly assigned application Ser. No. 08/065,935 identified above, knocked down boxes from a flexo-folder-gluer are stacked in a conventional counter ejector and the entire stack is transferred into a linear blade slitter which cuts through the entire stack, leaving two stacks of smaller regular slotted containers of either special or conventional construction. It has been found that a thin cutting blade, properly supported and driven at a small enough angle through the stack, can readily cut through a stack of folded knocked down boxes if properly oriented to slit essentially one box at a time and to allow the cut halves to part sequentially as the blade passes through the stack. The downward force of the blade on the layers of corrugated paperboard comprising the boxes will crush the corrugated medium unless the blade is moved through the stack at a small acute angle with respect to the plane of the end face of the stack (the plane of the means used to support the stack). Various types of linear slitting blades may be used, including a thin flexible blade clamped in a rigid blade support to expose only a small edge portion which defines the required slitting depth. The blades may be moved through the stack for cutting on a linear track means mounted for reciprocal movement through the cutting and return strokes.

In another embodiment, the cutting blade may comprise a continuous flexible band which operates linearly in one direction through a rigid blade guide with the guide and moving blade operated to pass directly through the stack of boxes. In this embodiment, linear blade movement is preferably at a speed about ten times as great as the speed of movement of the blade through the stack in a direction normal to the linear blade movement. Band blade slitting apparatus including rigid adjustable blade guide mechanisms have been developed for use in other slitting applications as shown, for example, in U.S. Pat. No. 3,393,538.

The continuous flexible band cutting blade which is used to slit the stack of boxes must have a sharp edge which is maintained throughout the continuous operation of the system. In past embodiments, such as pending application 08/341,752, a sharpening device is shown which sharpens two sides of a band blade passing therethrough. This sharpener, however, suffers from the problem of uneven sharpening on either side of the band blade, which in turn causes an uneven or unpredictable blade cutting surface. As a result, the blade may not track properly when moved through the stack, causing uneven cut edges on the boxes or other sheet material.

SUMMARY OF THE INVENTION

In accordance with the present invention, it has been found that a cutting blade comprising a continuous flexible band is particularly well suited to slit a stack of corrugated paperboard boxes. This flexible band cutting blade passes through a sharpening means which maintains the proper cutting surface on the blade.

A slitting apparatus for a stack of sheet material comprises a cutting blade which is formed from a continuous flexible steel band and includes a butt edge and an opposite sharpened cutting edge, a pair of spaced cylindrical blade drums which are rotatable on vertical axis and support the blade for slitting movement with the blade edge in a horizontal plane and defining a linear slitting path in a vertical plane between and tangent to the surfaces of the drums, a blade holder which supports the cutting blade for movement along the slitting path, which holder includes a pair of jaws with open upper ends having opposite lateral bearing surfaces to slidably engage the opposite side faces of the blade band and an internal portion which is vertically adjustable with respect to the jaws and has a blade supporting bearing surface in sliding engagement with the butt edge of the blade band, a mounting frame for the blade holder which extends generally along the slitting path and includes a base which has blade holder mounts on opposite ends for supporting attachment to the opposite ends of the blade holder for positioning the upper ends of the jaws to expose a selected portion of the blade side faces including the cutting edge, a blade tracking adjustment mechanism interconnecting the mounting frame and the adjustable internal portion of the blade holder and operative to move the blade supporting bearing surface and blade upwardly to maintain the selected blade exposure, a blade drum support frame which includes a pair of support brackets rotatably supporting the drums, one of said brackets having a pivotal attachment to the drum support frame to provide rotational adjustment on a pivot axis normal to the drum axis and to the slitting plane, and a bias adjustment mechanism interconnecting the drum support frame and the drum support bracket and operative to rotate the drum support bracket on its pivot axis and adjust the position of the blade drum rotation axis to maintain a selected biasing force of the blade butt edge on the blade supporting bearing surface.

The blade holder preferably comprises a pair of wear strips which define the lateral bearing surfaces and are attached to and form the upper ends of the jaws, the upper ends of the wear strips and the adjacent upper ends of the jaws defining divergent parting surfaces which extend downwardly from the opposite side faces of the blade. The jaws of the blade holder are interconnected with a mechanism which is operative to bias the jaws closed to hold the lateral bearing surfaces in sliding engagement with the blade side faces. Alternately, the biasing mechanism may be replaced with a rigid set screw assembly. Preferably, the apparatus includes a source of lubricated compressed air which is connected to apertures in the lateral bearing surfaces of the wear strips and forms an air bearing between those surfaces and the side faces of the blade.

Preferably, the blade supporting bearing surface comprises an elongate bar which extends substantially the full length of the blade holder and has a hard bearing surface, such as fine grained tungsten carbide. The blade tracking adjustment mechanism may comprise an adjustment plate mounted for vertical sliding movement between the base of the blade holder mounting frame and the blade holder, a series of laterally spaced vertically disposed pins which are attached at their lower ends to the adjustment plate and extend upwardly through the blade holder jaws with their upper ends in operative engagement with a lower surface of the elongate bar, and an actuator mounted between the blade holder base and the adjustment plate to move the plate, the pins, the elongate bar and cutting blade upwardly simultaneously. The elongate bar is preferably square in cross section and includes four identical hard bearing surfaces.

In a presently preferred embodiment, a pair of sharpening wheels are located in a position to contact the opposite flanks defining the cutting edge of the blade. The sharpening wheels are horizontally spaced from each other along the slitting path. Included in the sharpening assembly is an air cylinder to position and provide a source of contact force for the sharpening wheels. The sharpener assembly is positioned such that the flexible band cutting blade passes through the sharpener at a location which is opposite the cutting path of the system.

The sharpening device preferably includes an assembly arm which has an upstream and a downstream end positioned on opposite sides of the cutting blade such that the cutting blade passes between the upstream and downstream ends. Mounted to the assembly arm is a pivot plate. The pivot plate is coupled to the assembly arm about a pivot point which includes a torsion spring. The torsion spring provides a bias force to force the pivot plate into a desired position. Mounted to the pivot plate are a pair of rotatable abrasive wheels and driving means for each of the wheels. The abrasive wheels are mounted to the pivot plate such that one of the abrasive wheels contacts each side flank of the cutting blade. In this manner, each of the abrasive wheels is used to sharpen one of the side flanks on the cutting blade.

Preferably, a pressure device, such as an air cylinder, is connected to one corner of the pivot plate, such that upon activation, the pressure device causes the pivot plate to rotate with respect to the assembly arm. By rotating the pivot plate, the abrasive wheels mounted thereto are forced into contact with the cutting blade. In this manner, the sharpening device can be activated to sharpen the cutting blade.

In a preferred embodiment of the invention, the sharpening device includes a scraper positioned upstream from the sharpening device. The scraper contacts the cutting blade to remove debris from the cutting blade before it is sharpened. Preferably, the scraper includes a pair of scraping means to remove debris from the cutting blade in two steps.

Various other features, objects, and advantages of the invention will be made apparent from the following detailed description and the drawings.

BRIEF DESCRIPTION OF THE DRAWINGS

FIG. 5 is an end elevation of the blade holder.

FIG. 6 is an enlarged vertical section taken on line 6—6 of FIG. 4.

DETAILED DESCRIPTION OF THE PREFERRED EMBODIMENTS

Figure 1:
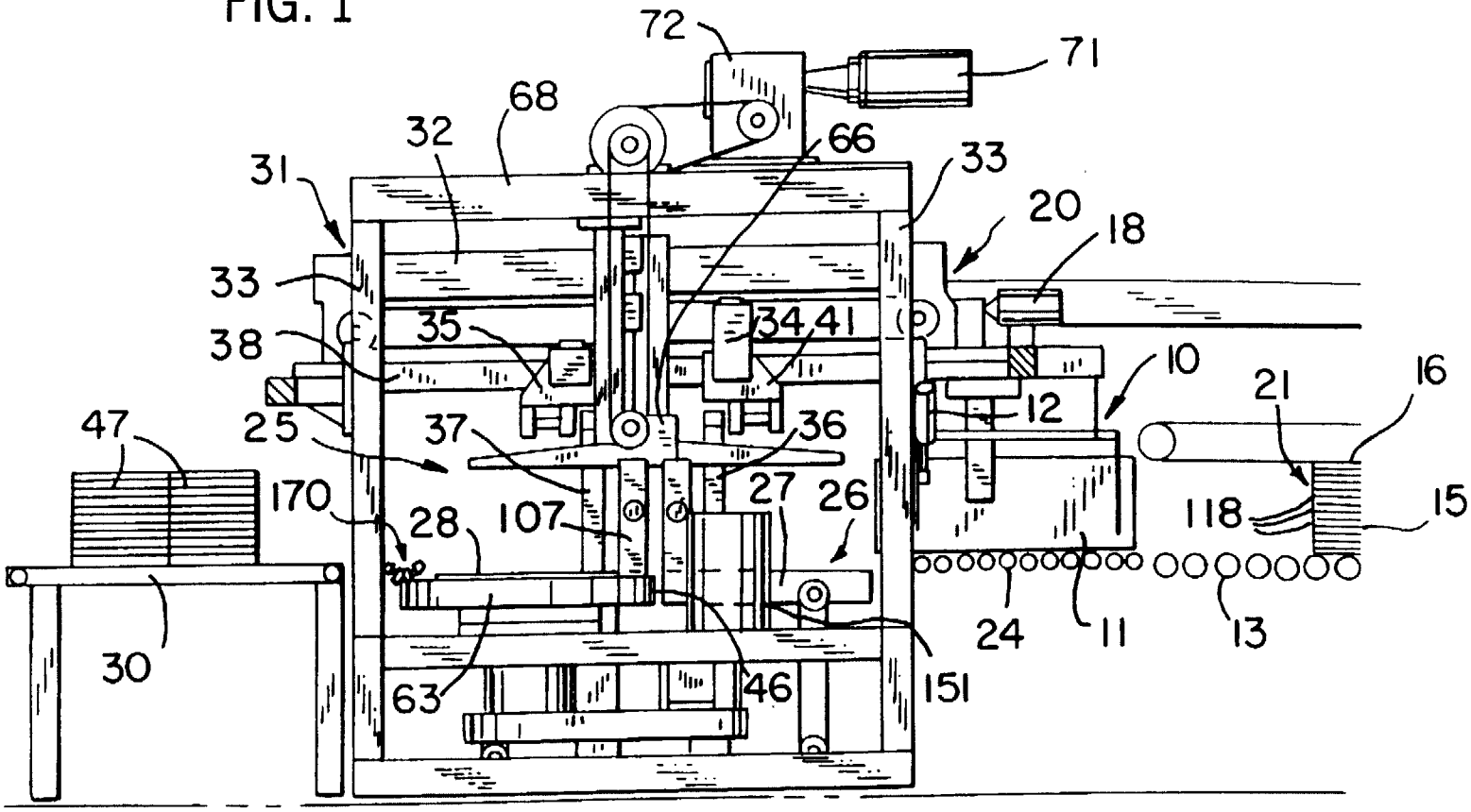
FIG. 1 is a side elevation view of the slitting apparatus.

Referring initially to FIG. 1, knocked down boxes of corrugated paperboard are formed from flat blanks in a flexo-folder-gluer (not shown), where the blanks are initially printed and the side edges are folded laterally toward one another and glued together along a thin glue tab on the overlapping edges. The folded knocked down boxes exiting the folding section of the flexo are formed in a vertical stack of a pre-selected number of boxes in a conventional counter ejector (not shown). The corrugated containers made from double wall board (i.e. 3 liners enclosing two corrugated media) may have a folded two layer thickness of 0.625 inch (about 16 mm), such that a stack of 16 boxes formed in the counter ejector would be about 10 inches (25 cm) high. Because of the inherent spring back in the folded boxes, the freestanding stack is somewhat higher and the stack is fed from the counter ejector between a lower discharge conveyor 13 and an upper compression conveyor to compress the stack 15 to a nominal 10 inch height.

It will be appreciated that, as is well known in the industry, the folded edges of the boxes 16 comprise the lateral edges as each box is formed in the flexo and lie parallel to the line of box movement through the flexo. Correspondingly, the cut edges of the boxes are oriented transversely to the direction of box movement. The boxes are moved through the counter ejector and between the conveyors without any reorientation in the horizontal plane, so that the stack 15 of boxes arrives at the inlet of the box slitting apparatus 20 with the lead or downstream face 21 of the stack defined by the leading cut edges 18.

From the lower discharge conveyor 13, the stack 15 is transferred onto a powered infeed conveyor 24 which, in turn, transfers the stack into the slitting station 25 of the slitting apparatus 20. Because the stacks 15 formed in the upstream counter ejector are rarely truly square, it is desirable, before transferring the stack into the slitting station 25, to square the stack laterally, i.e. to align the folded edges on each side of the stack in respective vertical planes. A side tamp apparatus 10, shown generally schematically in FIG. 1, is positioned above the infeed conveyor 24. A pair of tamper plates 11 (only the near side plate being shown in FIG. 1) are each pivotally mounted to move from an upper inoperative position to a vertical operative position in a plane parallel to the folded edges of the boxes in an incoming stack 15. The infeed conveyor 24 is continuously operated to receive the sequentially delivered incoming stacks 15. Each of the plates 11 is rotated downwardly by extension of its own positioning cylinder 12. The far side tamper plate 11 is laterally positionable, as will be described in more detail hereinafter, to position it from the near side tamper plate a distance approximating the width of the incoming stack. A laterally extendable tamping cylinder 19 is then extended to tamp and square the stack as it is moved by the infeed conveyor 24 into the slitting station. A lower stack supporting table in the slitting station 25 comprises a powered roller conveyor 26. The roller conveyor 26 includes an upstream section 27 and a downstream section 28 which are separately driven. The powered roller conveyor 26 is normally positioned in an upper stack receiving and discharge position which is coplanar with the infeed conveyor 24 and a downstream outfeed conveyor 30.

The supporting frame 31 includes an upper gantry mechanism 32 which is supported by a horizontal support structure extending between laterally spaced pairs of intermediate vertical support columns 33, the lateral spacing of which is preferably great enough to provide pass-through of unfolded boxes, if desired. The gantry mechanism 32 supports an adjustable upstream squaring device 34 and a similar adjustable downstream squaring device 35, which together aid in maintaining and re-establishing squareness of the stack during and after slitting. The upstream squaring device 34 includes a pair of pivotally mounted squaring paddles 36 which are movable together in either direction on the line of stack movement through the slitting station, adjustable laterally to vary the distance between them in the cross machine direction (normal to the direction of stack movement), and may be pivoted into and out of the path of stack movement. Similarly, the downstream squaring device 35 includes a pair of downstream squaring paddles 37 which are also movable together toward or away from the upstream paddles, adjustable in the cross machine direction to vary the distance between them, and pivotally mounted to rotate into and out of the path of stack movement, all as will be described in greater detail below.

One of each pair of upstream squaring paddles 36 and downstream squaring paddles 37 is mounted for opposite reciprocal sliding movement along a fixed paddle supporting beam 38 attached to the supporting structure extending between an upstream and a downstream intermediate column 33 and forming part of the upper gantry mechanism 32. Each of the other pair of upstream and downstream paddles 36 and 37 is similarly supported for reciprocal sliding movement in opposite directions along a laterally adjustable paddle supporting beam parallel to the fixed beam 38. Each of the paddles 36 and 37 is suspended from and pivotally attached to a paddle carriage 41 which, in turn, is mounted on linear bearings 42 to slide along one of the supporting beams 38 or 40 parallel to the direction of movement of the stack 15 through the system. Paddle pivot shafts 43 support each of the paddles from the underside of its respective paddle carriage 41. A paddle pivot arm 45 connects each shaft 43 to the rod end of a paddle cylinder 44, the cylinder end of which is attached to the paddle carriage 41, such that cylinder retraction causes the paddle to pivot from a vertical operative position in the path of stack movement to an upper inoperative position out of the path.

Opposite reciprocal movement of each upstream pair of paddles 36 with respect to and in an opposite direction from each downstream pair of paddles 37 is utilized, in conjunction with pivotal movement of the paddles, to perform several distinct sequential functions in the process of bringing a stack 15 of boxes 16 into the slitting station 25, squaring and centering the stack over a slitting blade 46 positioned between the upstream and downstream sections of the supporting conveyor 26, guiding the boxes in the stack as it is moved vertically downwardly through the slitting blade 46, and re-squaring the two half-size stacks 47 of smaller boxes resulting from the slitting operation.

As shown generally in FIGS. 2, 4–6, the slitting blade 46 is made from a continuous flexible steel band having an upwardly oriented cutting edge 61 and an opposite lower butt edge 62. The blade is entrained around a driven blade drum 63 and an idler drum 64 mounted on vertical drum axes on opposite sides of the slitting station 25 and positioned with the upper cutting edge 61 in a horizontal plane and one run of the blade positioned in the vertical cutting plane 60 to define a linear slitting path. The slitting blade 46 is accurately held in the slitting path by an adjustable blade holder 65 which extends substantially the full length of the linear slitting path transversely across the supporting roller conveyor 26 to maintain the cutting edge 61 just below the plane of the roller conveyor 26 in its upper stack receiving and discharge position.

With a stack 15 of boxes 16 centered in the slitting station 25 over the slitting blade 46, an overhead ram 66 (FIG. 1) having a lower flat horizontal pusher surface 67 is brought vertically downwardly into contact with the top of the stack 15 and, as it continues downwardly, overcomes an upward biasing force holding the upstream and downstream sections 27 and 28 of the roller conveyor 26 in their coplanar horizontal positions and pushes the stack downwardly through the blade to form the two half-sized stacks. The ram is mounted on and suspended from an upper horizontal framework 68 which, in turn, is supported on the upper ends of lateral pairs of outer vertical support columns. The ram is driven vertically up and down by a servomotor 71 and reducer 72 mounted atop the horizontal framework 68.

As indicated above, the two sections 27 and 28 which comprise the powered roller conveyor 26 in the slitting station are biased upwardly with a force sufficient to hold the stack 15 in the slitting position, but which biasing force is overcome by the downwardly descending ram 66. A dual pressure level control provides the lower level biasing force which is activated just prior to downward movement of the ram and held during slitting. A higher bias pressure level is otherwise maintained to allow pass through of stacks not being slit. The conveyor sections 27 and 28 are mounted to move together in synchronism under the influence of the ram and to return to their common upper stack receiving and discharge position as the ram retracts upwardly. Each of the upstream and downstream conveyor sections 27 and 28 is identical and includes a table-like frame carrying a series of parallel rollers along its upper edge which rollers are driven in unison from below by direct frictional contact from a drive belt in the manner of a conventional live roller conveyor.

As previously indicated, the upstream squaring paddles 36 and downstream squaring paddles 37 provide a stack squaring and centering function, as well as a guiding function as the stack is being pushed downwardly through the slitting blade 46 by the ram 66. Thus, referring particularly to FIG. 1, each pair of paddles 36 has a pair of squaring faces which engage the upstream face of the stack, while a similar pair of squaring faces on the downstream paddles 37 engage the downstream face 21 of the stack. However, as shown in the drawings, the lower ends of the paddles 36 and 37 lie just above the surfaces of the respective upstream and downstream conveyor sections 27 and 28 when the paddles are pivoted downwardly into their operative positions. As the conveyor sections descend along opposite sides of the blade holder 65 as a result of downward movement of the ram 66 and passage of this stack through the slitting blade 46, it will be appreciated that there are no upstream or downstream squaring faces to restrain the respective downstream and upstream movement of the slit boxes comprising the two half-size stacks resulting from the slitting operation. As the main stack 15 is moved downwardly through the blade, a single box 16 at a time is slit, and the slit halves are deflected in respective upstream and downstream directions as they pass over the tapered diverging surfaces defining the nose or upper end of the blade holder 65. Such relatively uncontrolled movement of the half-size boxes will result in an unacceptable scattering and a gross loss of stack alignment.

To maintain substantial vertical alignment of the half-size stacks 47, each of the squaring paddles 36 and 37 includes a squaring face extender mounted to extend downwardly from the hollow interior of the paddle by extension of an air cylinder mounted therein and attached to the upper end of the extender. Box edge stops on the extenders are recessed from the main squaring faces on the paddles 36 and 37 to accommodate the required parting of the box halves by an amount roughly equivalent to the width of the blade holder 46. The extender air cylinders are operated in unison to extend with downward movement of the ram 66 and are timed to coincide with downward movement of the roller conveyor table sections 27 and 28.

Basic operation of the slitting apparatus 20 thus far described is as follows. With the powered rollers in both the upstream section 27 and downstream section 28 running and the slitting blade 46 operating, the downstream paddles 37 are pivoted downwardly into their operative positions disposed vertically over the downstream conveyor section 28 by extension of the paddle cylinders 44. A stack 15 passes from the infeed conveyor 24 into the slitting station 23 and is carried by the roller conveyor 26 over the running blade and into the squaring faces 101 of the downstream paddles 37. The upstream paddles 36 then rotate downwardly by extension of their respective paddle cylinders 44 into operative position with the squaring faces adjacent the upstream face 22 of the stack. The drive cylinder is extended to drive the splined driveshaft and interconnected paddle drive belts causing paddle pair 36 and paddle pair 37 to move toward one another, engage the stack faces and center the stack 15 precisely over the slitting blade 46. For the particular length of boxes 16 in the stacks being run, as measured between the opposite cut edges 18 in the direction of stack movement, the tooth clutch is manually operated to move the paddle belts and set the desired stack length. Immediately upon centering of the stack, the brake on the driveshaft is locked to fix the paddle pairs in position. Locking is necessary to prevent the diminishing number of uncut boxes in the descending stack from being held between the paddle pairs as a result of the decreasing resistance provided by fewer boxes to the air pressure applied by the paddle centering cylinder. If the paddles are not locked in centering position, the increasing pressure on the stack faces will cause the remaining boxes to bow. With the paddles locked in position, the ram 66 moves down onto the top of the stack and compresses the stack somewhat onto the supporting roller conveyor 26 until the low pressure level bias of the table air cylinder is overcome and the conveyor sections 27 and 28 descend synchronously and the stack passes through the slitting blade 46. Simultaneously with downward movement of the supporting conveyor sections, the extender air cylinders are activated to extend the squaring face extenders vertically downward. The cut box halves part downstream and upstream into the edge stops presented by the extenders and, simultaneously with movement of the uppermost box in the stack through the slitting blade 46, the brake is released and the paddle drive cylinder is retracted causing the paddle pairs 36 and 37 to move apart slightly further in equal opposite directions. The ram drive servomotor 71 is then reversed and the ram 66 is moved upwardly at a speed sufficient to follow the upward movement of the stack supporting conveyor sections 27 and 28 under the influence of the high level pressure of the biasing air cylinder. Return upward movement of the ram 66 is controlled to allow the horizontal pusher surface to maintain a slight stack pressure which is sufficient to prevent the half-size boxes forming the two stacks 47 from being knocked further out of alignment as the conveyor sections reach their upper horizontal positions and the rod end of the biasing air cylinder reaches the end of its stroke and engages a shock absorber attached to a vertical frame member above the master timing belt 97. The additional distance by which the paddle pairs 36 and 37 are moved apart as the last box in the stack moves through the slitting blade provides clearance for the upward return of the half-size stacks 47 as a result of their parting movement past the blade holder 65. Upward movement of the ram, stacks 47 and stack supporting conveyor sections is also accompanied by retraction of the squaring face extenders back into their respective paddles 36 and 37. At the same time, the downstream paddles 37 are rotated upwardly to their inoperative positions by retraction of the paddle cylinders. The control system again activates the squaring paddle drive cylinder in a direction to again centering movement of both the upstream pair 36 and the downstream pair 37 of squaring paddles. However, because the downstream paddles 37 have already been moved to their inoperative positions out of the path of stack movement, only the upstream pair of paddles 36 will engage the upstream face of the upstream half-size stack 47, re-squaring that stack and moving it into the adjacent face of the downstream half-size stack and automatically re-squaring that stack as well. This paddle motion also keeps narrow half-size stacks from tipping over when the conveyors 27 and 28 are started for discharge. Re-squaring movement of the upstream paddles 36 is followed immediately by startup of the motors driving the rollers for each of the sections of the powered roller conveyor 26 and the two half-size re-squared stacks 47 move out of the slitting station and onto the powered outfeed conveyor 30. The upstream squaring paddles 37 are also rotated upwardly to their inoperative positions.

To accommodate stacks of boxes of varying width in the cross machine direction, the lateral distance between the paddles comprising the upstream pair 36 and the same lateral distance between the paddles comprising the downstream pair 37 is adjustable. As indicated earlier, one of each upstream squaring paddles 36 and downstream squaring paddles 37 is mounted for adjustable movement along the fixed paddle supporting beam 38 while the other pair of upstream and downstream paddles 36 and 37 is similarly mounted for reciprocal sliding movement along the laterally adjustable paddle supporting beam.

Figure 4:
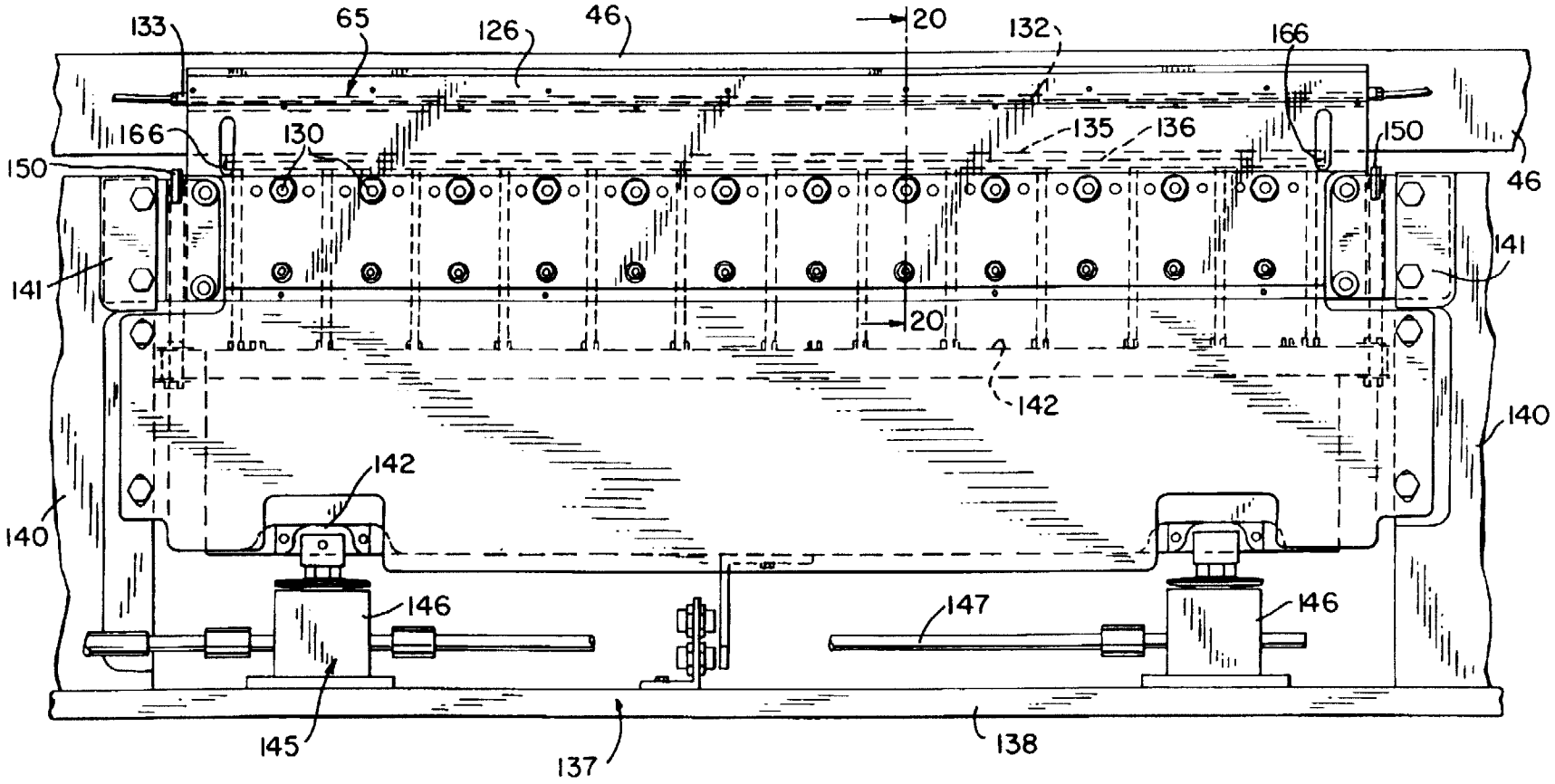
FIG. 4 is an elevation view of the slitting blade holder.

Referring also to FIGS. 4–6, the blade holder 65 comprises a pair of jaws 126 which substantially enclose and carry the slitting blade 46 for sliding movement in the cutting plane 60. The jaws 126 are biased to enclose the side faces of the blade between a pair of lateral bearing surfaces, preferably in the form of steel wear strips 127 having low friction face coatings. The strips 127 are set into the upper end of each jaw and held in place by a series of machine screws 129 running the length of the jaws. The total height of the slitting blade 46 may be, for example, 3⅜ inches (8.5 cm), but only about 0.4 inch (10 mm) of the blade including the upper cutting edge 61 is exposed. The noses of the jaws and corresponding adjacent portions of the wear strips 127 are tapered to form the diverging surfaces 102 over which the slit box halves pass and part as the stack moves downwardly through the blade. The total included angle between the surfaces 102 is preferably about 45° and the surfaces are polished, all to enhance cutting efficiency and reduce box edge crush. To provide a light biasing force of the wear strips 127 against the side faces of the slitting blade 46, the jaws 126 are pivotally attached for rotation on a pivot axis 128 defined by a series of T-bolts 130 mounted along the length of the blade holder. The bottom ends of the jaws are biased apart by a series of bias springs 131, also mounted along the length of the blade holder, the combined force of which closes the wear strips 127 against the blade, as indicated. In an alternate construction, the bias springs 131 may be eliminated and replaced with a series of solid set screws.

Preferably, the wear strips 127 have a series of elongate apertures 132 along their lengths which are connected by a common supply duct to a source of compressed air via an appropriate connection 133 at one end of each of the jaws. Supplying compressed air, which preferably has oil entrained therein, provides an air bearing between the wear strip surfaces and the side faces of the slitting blade to allow close guiding contact of the blade without excessive wear.

The jaws 126 define an open interior portion 144 which houses a vertically adjustable blade support 134 upon which the butt edge 62 of the slitting blade is slidably supported as the blade travels through the blade holder. The blade support 134 includes an upper carbide bar 135 which provides direct sliding support for the blade. The carbide bar 135 is preferably formed of three identical longitudinally abutting bar sections, each having a square cross section and being repositionable to provide four wear surfaces before replacement. A square cross section steel bar 136 of the same size and shape as the three-piece carbide bar 135 supports the latter from below and the bars are vertically adjustable (in a manner to be described) to provide the desired upper blade edge exposure and move the blade vertically to maintain such exposure as the blade wears.

The blade holder 65 is mounted on and supported by a mounting frame 137 secured to the lower stationary frame 87. The mounting frame 137 includes a generally horizontal base 138 having a pair of upwardly extending blade holder mounts 140 on opposite ends thereof. The opposite ends of one of the jaws 126 of the blade holder 65 are attached to the upwardly extending blade holder mounts 140 by mounting brackets 141. This places the nose of the blade holder slightly below the horizontal plane of the roller conveyor 26 in the slitting station. To adjust the amount of blade edge exposure beyond the nose of the blade holder jaws 126, the slitting blade 46, its supporting carbide bar 135 and the backing bar 136 are moved vertically together by an adjustment plate 142 which is mounted for vertical sliding movement between the base 138 of the blade holder mounting frame 137 and the blade holder 65. A series of parallel spaced vertically extending pins 143 are attached to the upper edge of the adjustment plate and extend upwardly through open slots between the abutting portions of the lower halves of the jaws 126. The upper ends of the pins 143 extend into the open portion 144 of the blade holder in which the bars 135 and 136 are disposed for vertical sliding movement. The pins 143 engage the underside of the steel bar 136 such that adjustable vertical movement of the adjustment plate 142 will result in vertical movement of the cutting blade vertically between the blade holder jaws 126. Vertical movement of the adjustment plate 142 and thus vertical positioning of the slitting blade within the blade holder 65 is provided by an actuator mechanism 145 mounted between the base 138 of the mounting frame and the underside of the adjustment plate 142. The actuator mechanism 145 includes a pair of lead screw actuators 146 attached to the base 138 adjacent opposite ends of the adjustment plate 142 and having their upper screw ends rotatably attached to the lower edge of the adjustment plate. The actuators 146 are connected by a common driveshaft 147 and are timed to operate together within a very close tolerance of less than 0.003 inch (0.08 mm). The actuators are driven by a motor 148.

Figure 16:
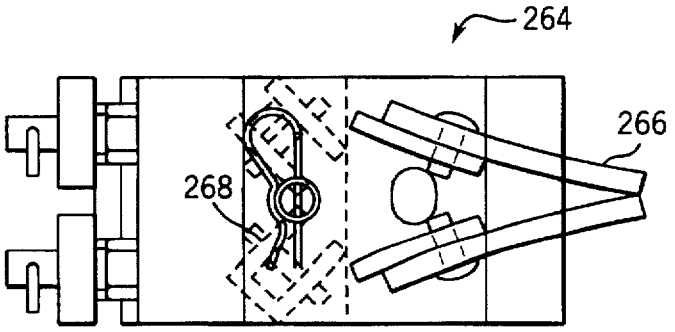
FIG. 16 is a top plan view of the scraper of the sharpener assembly.

As indicated previously, it is desirable to maintain a blade exposure dimension of 0.4 inch (10 mm) which is greater than the thickness of a conventional double face corrugated paperboard sheet, yet adequate to slit a double wall sheet without crushing. The blade edge exposure is preferably maintained within ±0.030 inch (0.8 mm) and a sensing system is provided to maintain the desired blade edge exposure automatically. A pair of upper and lower blade edge height sensors 180 are mounted on a bracket 182 which is attached to a vertical frame member adjacent one end of the blade holder, as shown in FIG. 16. The sensors detect upper and lower limits of blade height and the signals are processed to automatically operate the motor 148 to assure that the slitting blade tracks with the desired blade edge exposure. This blade tracking adjustment is utilized to move the blade vertically upwardly to adjust for blade wear. Blade edge wear is caused by abrasive action of the paperboard cut in the slitting operation of the blade and the use of an automatic blade edge sharpening device to be described.

Figure 3:
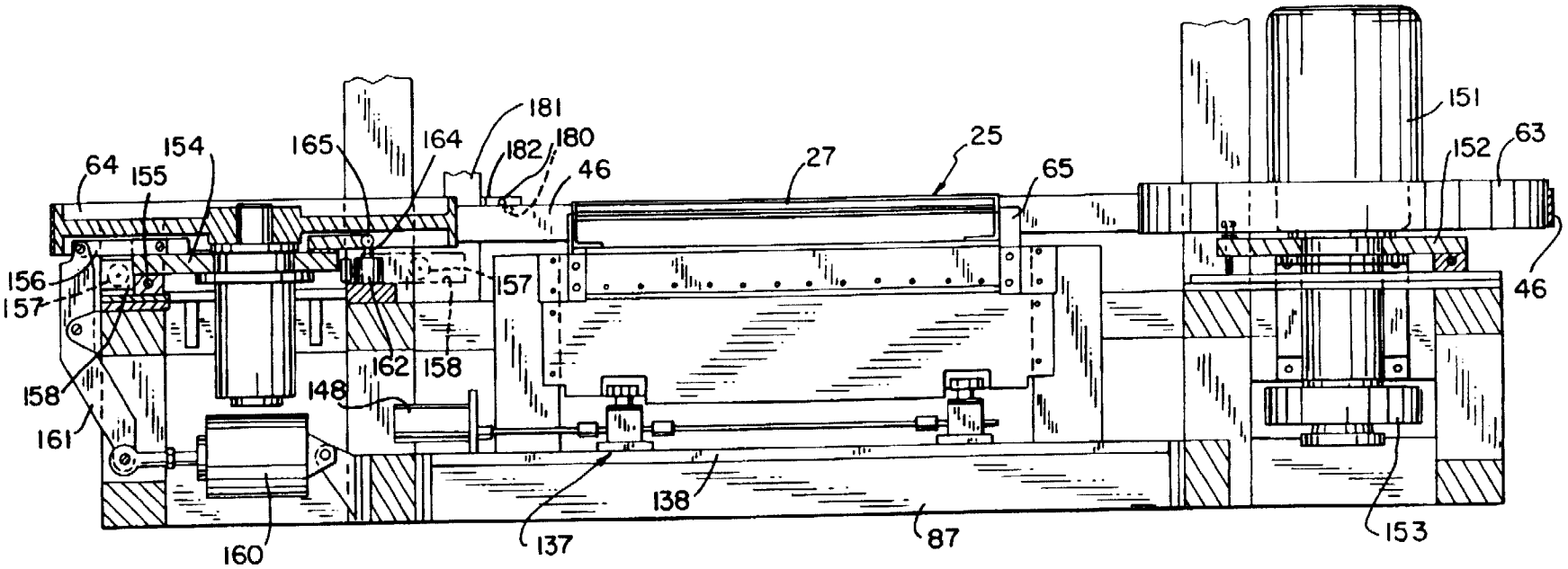
FIG. 3 is an end elevation of the apparatus shown in FIG. 2 viewed in the downstream direction.

As also shown in FIG. 3, the blade drums 63 and 64 around which the slitting blade 46 operates are mounted to the lower stationary frame 87 on lateral opposite sides of the slitting station 25 and offset in a downstream direction as shown. Blade drum 63 is rotatably mounted on a fixed base plate 152 and driven by a motor/reducer 151 with a conventional belt drive 153. The opposite idler blade drum 64 is mounted for two modes of adjustment to control blade tension and to control the biasing force of the blade butt edge 62 on the carbide support bar 135 in the blade holder. Thus, blade drum 64 is rotatably mounted on a pivotal drum support plate 154 via a pivot pin 155 to a horizontally adjustable base plate 156. The base plate 156 is supported for horizontal movement toward and away from the driven blade drum 63 by cam wheels 157 running along a pair of opposite C-channel members 158 attached to the supporting frame 87. Blade tension is maintained by an air cylinder 160 mounted on the frame 87 and operatively attached to one edge of the adjustable base plate 156 by a blade tension linkage 161. A blade biasing actuator 162 is attached to the adjustable base plate 156 on the edge opposite the tension linkage 161. The actuator is driven by a small motor 163 and includes an actuating lead screw 164 having an upper end in engagement with a cam bearing 165 attached to the pivotal drum supporting plate 154. Operation of the biasing actuator 162 to move the lead screw 164 upwardly will result in upward pivotal movement of the support plate 154 about the pivot pin 155 and against the force of blade tension. Opposite movement of the lead screw 164 in the downward direction results in opposite pivotal movement of the drum supporting plate 154 under the influence of slitting blade tension.

It has been found that careful control of the biasing force of the butt edge 62 of the slitting blade 46 on the wear surface of the carbide bar 135 in the blade holder is extremely important to avoid, on the one hand, excessive blade and bar wear if the blade is biased against the carbide bar with too great a force and, on the other hand, undesirable upward tracking of the blade and potentially damaging shock loadings if the biasing force is insufficient and contact between the blade and the carbide wear bar 135 is lost. Control of the biasing actuator 162 is based on signals generated by temperature sensors 166 (FIG. 4) mounted at the ends of the steel bar 136 which supports the carbide wear bar 135 in the blade holder 65 as previously described. If the temperature sensed at either end of the blade holder moves above or below set limits, the indication is that the blade is exerting, respectively, too much or too little pressure on the carbide support 135. The control system, such as a conventional PLC, signals the biasing actuator 162 to move the pivotal drum supporting plate 154 in the appropriate direction to re-establish the proper temperature and, therefore, the desired level of uniform force of the blade on the carbide support. If the actuating lead screw 164 is moved upwardly, causing the drum support plate to be lifted, the blade will track downwardly, and vice versa. The temperature range is selected to maintain a downward preload of the slitting blade on the carbide support 135 to prevent any bounce as a stack load is imposed on the blade edge and to eliminate any tendency of the blade to track upwardly off the drums during operation. Actual blade movement effected by the biasing actuator 162 is extremely small. For example, the actuator may be constructed and operated to provide drum support plate movement of 0.0025 inch (0.06 mm) with a one second operating pulse.

It has been found to be very important to assure that the lower butt edge 62 of the slitting blade does not move out of contact with the carbide supporting bar 135 in spite of automatic control by the biasing actuator 162. The ram 66 may operate with a downward force of 3,000 pounds (13,0000 N) and the resultant shock loading which would result, if the blade were running off the supporting carbide bar, could cause damage to the blade, blade holder or blade drive system. Blade height sensors 150 are attached to the upper edges of the blade holder mounts 140 to monitor the distance to the butt edge of the slitting blade. If the preset distance is exceeded, the signal from the sensor causes the controller to disable operation of the ram.

It is important both for maintenance of blade life and assurance of slit quality to provide blade lubrication and blade sharpening. Most conveniently, the lubricating device 168 is mounted near the upstream end of the slitting run of the blade and applies a continuous metered amount of a lubricant to the side faces of the blade which lubricant is beneficially transferred to the faces of the wear strips 127 and carbide wear bar 135 as well.

A blade having an initial total height of 3⅜ inches (8.6 cm) may be operated to a final blade height of 2⅛ inches (5.4 cm) before replacement. Thus, the blade tracking system is capable of providing a total of 1¼ inches (3.2 cm) total upward blade adjustment. The slitting blade may be operated at a speed of about 1,200 fpm (6 m/sec) and the ram 66 operated at a vertical downward speed of about 120 fpm (0.6 m/sec). The resultant ratio of horizontal to vertical movement of the blade edge in a ratio of 10:1 results in a very small effective angle of linear movement of the blade through the stack, i.e. about 6°. However, by maintenance of proper blade alignment, sharpness and lubrication, the angle may be increased substantially, e.g. by reducing blade speed or increasing ram velocity, and cut quality still maintained.

Figure 2:
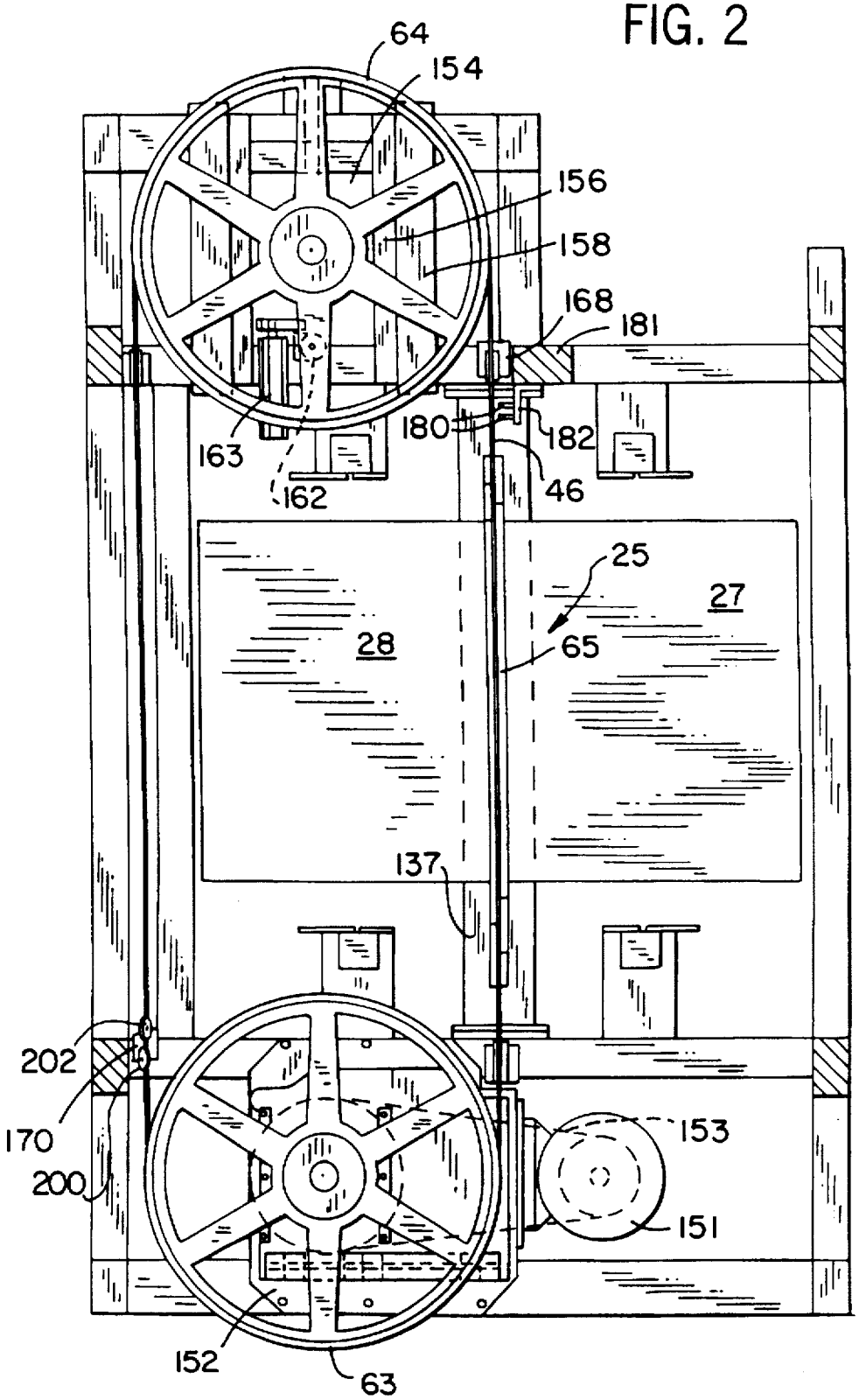
FIG. 2 is a top plan view of the slitting blade drive and sharpener assembly.
Figure 7:
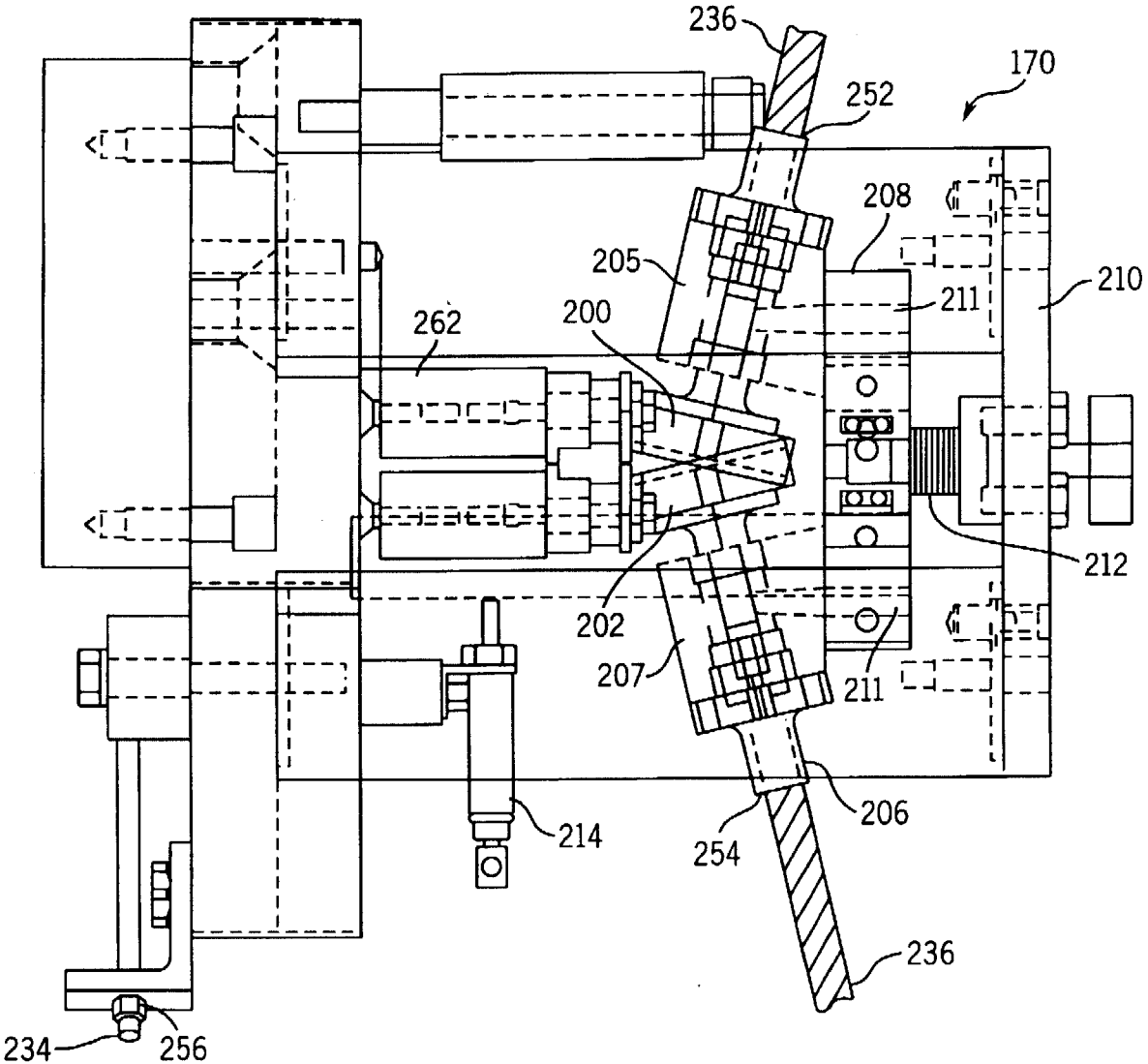
FIG. 7 is an end elevation plan view of the sharpener assembly.

As shown in FIGS. 1 and 2, a sharpening assembly generally designated 170 is most conveniently mounted on the return run of the slitting blade 46 downstream of the slitting station. As can better be seen in FIGS. 7 and 8, the sharpening device 170 contains a pair of abrasive wheels 200,202 which engage the flanks of the cutting edge 61 of the flexible band cutting blade 46. Abrasive wheel 200 is mounted on a wheel drive 204 while abrasive wheel 202 is mounted on a wheel drive 206. Since both the wheel drives 204 and 206 are located on opposite sides of the moving flexible band cutting blade 46, wheel drive 204 must be operated in a forward direction while wheel drive 206 is operated in a reverse direction. Each of the wheel drives 204,206 contains a sharpener head 205,207 to which the respective abrasive wheels 200, 202 are rotatably mounted. Each of the wheel drives 204, 206 is mounted to a pivot plate 208 by a pair of connectors 209 each contained in a mounting aperture 211 extending through the pivot plate 208 and into the sharpener heads 205 and 207, as shown in FIG. 7. The pivot plate 208 is joined to an assembly arm 210. Assembly arm 210 and pivot plate 208 are coupled by a torsion spring 212. The torsion spring 212 surrounds a pivot connection between the pivot plate 208 and the assembly arm 210 such that when no force is applied to the pivot plate 208, the pivot plate 208 and assembly arm return to the position shown in FIG. 9.

Figure 8:
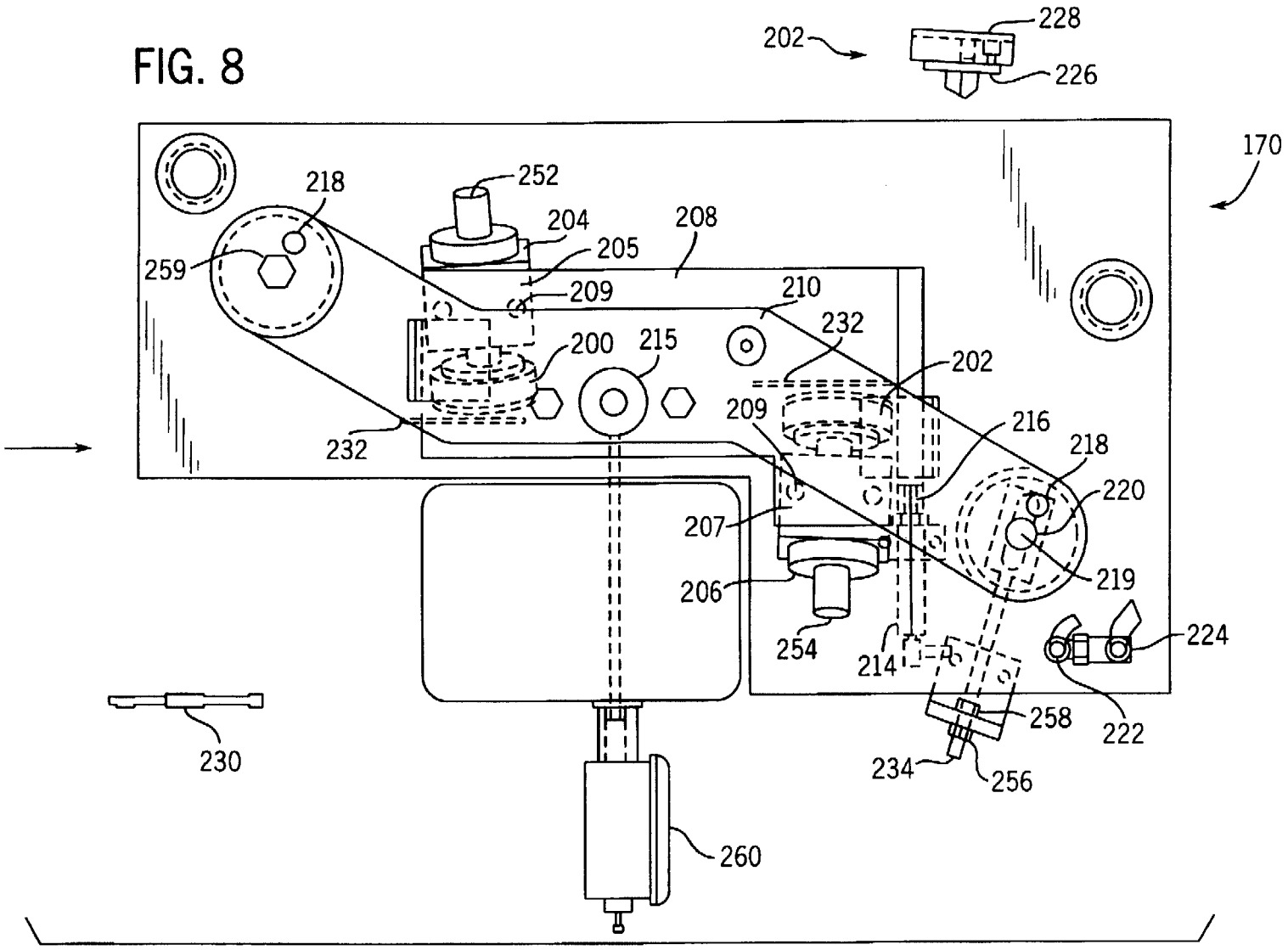
FIG. 8 is a top plan view of the sharpener assembly.

The sharpener assembly 170 further includes an air cylinder 214 having a spacer 216. Air cylinder 214 is used to maintain pressurized contact between the abrasive wheels 200, 202 and the cutting blade 46. The pressurized contact between the abrasive wheels and the cutting blade 46 is accomplished by applying a source of pressurized air to air cylinder 214. When pressurized air is supplied to the air cylinder 214, the air cylinder exerts pressure on the corner of the pivot plate 208 causing the pivot plate 208 to overcome the force of the torsion spring 212 and pivot about a fixed point 215. When air cylinder 214 is activated, a cylinder rod (not shown) exerts a force on the pivot plate 208 which causes the pivot plate 208 to rotate about the pivot point 215 in a counterclockwise manner. This counterclockwise rotation of pivot plate 208 about pivot point 215 causes the abrasive wheels 200,202 to move toward and exert force on the cutting blade 46 passing therethrough. As can be seen in FIG. 8, the pivot point 215 is located at the central point between the point of contact between abrasive wheel 200 and the blade 46 and the point of contact between abrasive wheel 202 and the blade 46. The pivot point 215 must be at this exact center point so that upon rotation of the pivot plate 208, the abrasive wheel 200 and the abrasive wheel 202 exert equal pressure on blade 46 passing therebetween. After the sharpening is completed, the air cylinder 214 is deactivated, whereby the torsion spring 212 located about the pivot point 215 causes the pivot plate 208 to return to its resting position, whereby the abrasive wheels 200, 202 are no longer in contact with the cutting blade 46. The spacer 216 acts to limit the rotation of pivot plate 208 caused by the torsion spring 212 after deactivation of the air cylinder 214. By modifying the length of the spacer 216, the position of the pivot plate 208 when the air cylinder 214 is deactivated can be adjusted.

The assembly arm 210 contains a pair of alignment pins 218, a lockdown screw 219, and a lockdown slot 220. The pair of alignment pins 218 correctly position the assembly arm 210. The lockdown screw 219 is engaged in slot 220 such that the assembly arm 210 is movable to adjust the position of the abrasive wheels 200 and 202.

Connected to the sharpener assembly are a pair of water hose connectors 222,224. The water hose connectors 222, 224 provide a source of water to the abrasive wheels 200,202. This source of water is continuously fed through a bracket containing a nozzle (not shown) which is connected to the lower surface of pivot plate 208. A water supply is used to lubricate and cool the abrasive wheels 200,202 to prevent sparks and the build up of heat. This source of water aids in both fire prevention and the lubrication of the cutting blade 46. As can be seen by examination of the isolated abrasive wheel 202 of FIG. 8, the abrasive wheel 202 is connected to the wheel drive 206 by a wheel arbor 226 and is securely held in place by a wheel screw 228. Also shown in an exploded view in FIG. 8 is a turning tool 230 to be described hereinafter.

Shown in FIG. 8 are a pair of splash guards 232. Splash guards 232 are positioned to prevent the water applied to the abrasive wheels 200, 202 from excessively contacting other portions of the sharpening assembly 170. Also shown in this FIG. is an adjustment rod 234 which is used to adjust the position of the assembly arm 210 and thereby modify the position of the abrasive wheels 200, 202.

Figure 10:
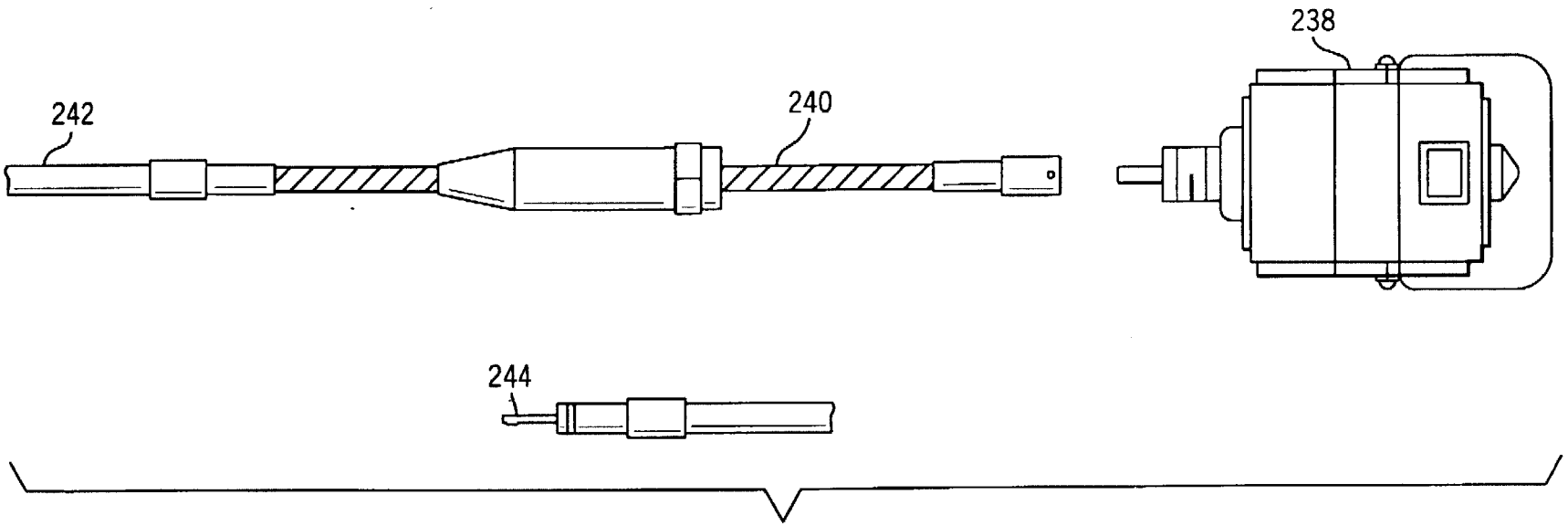
FIG. 10 is an exploded view of the drive motor of the sharpener assembly.

As shown in FIG. 7, a cable 236 containing a flexible shaft extends from wheel drive 206. A similar cable extends from wheel drive 204. Cable 236 is connected to the motor 238 shown in FIG. 10. A flexible shaft 240 extends through a sheath 242 and a shaft tip 244 and is used to connect the motor 238 to the sharpener assembly 170.

Figure 9:
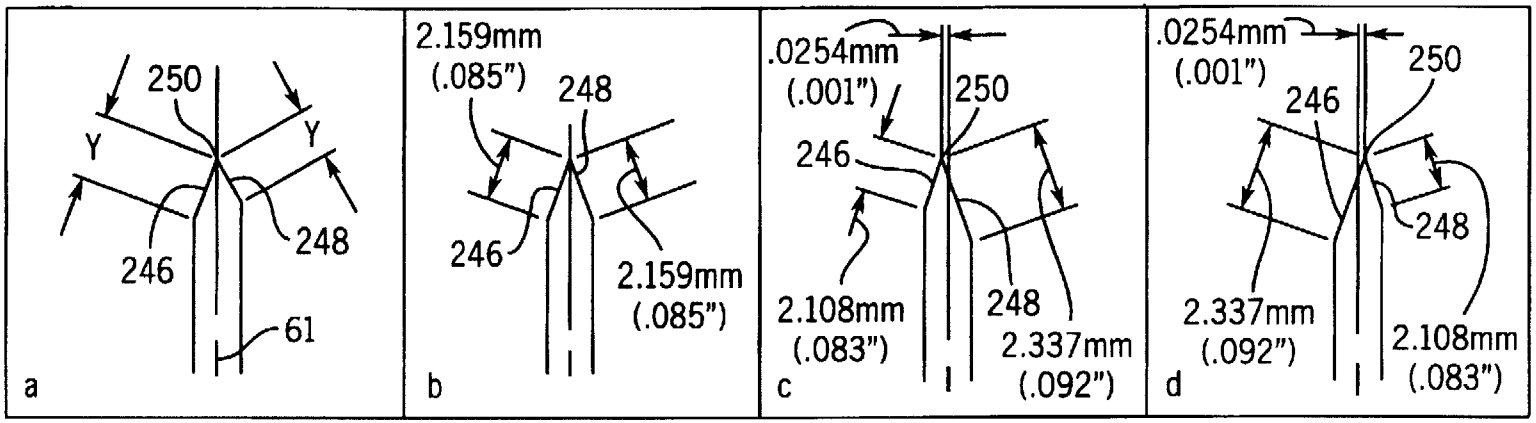
FIG. 9 is an end elevation of the slitting blade showing correct and incorrect sharpening.

Shown in FIG. 9 are the blade tip 61 and the two flanks 246,248 of the tip 61. Shown in FIG. 9A is the largest allowable difference between flanks 246 and 248. In FIG. 9A, flank 246 is 1.1 times the length of flank 248. If the flanks 246 and 248 ever differ by more than this ratio, the sharpener 170 needs to be adjusted to even out the sharpened edges. FIG. 9B shows an optimally sharpened blade tip 61. FIG. 9C shows an instance where blade flank 248 is improperly sharpened and the tip 250 is located a distance laterally from the center of blade 61. FIG. 9D shows a similar situation in which the tip 250 is off center in the other direction.

To adjust the sharpener 170, the turning tool 230, FIG. 8, is inserted into both of the sharpener head shafts 252,254 of the wheel drives 204,206 to determine which head accepts the most turning force. In the preferred embodiment, the air cylinder 214 is engaging the abrasive wheels 200 and 202 to the blade with 172 kPA (25 psi) of air pressure or 22 N (5 lb) of force. The engagement travel of the abrasive wheels 200 and 202 should be no greater than 3 millimeters (0.13 inches). Also shown in FIG. 8 are an outside jam nut 256 and an inside jam nut 258. The outside jam nut 256 and the inside jam nut 258 are both used to modify the length of adjustment rod 234. By changing the length of adjustment rod 234, the assembly arm 210 moves in the lockdown slot 220 to modify the position of the abrasive wheels 200,202 with respect to the cutting blade 46. By changing the length of the adjustment rod 234, the assembly arm 210 rotates about a fixed pivot point 259. If the assembly arm 210 is rotated clockwise about the fixed pivot point 259, the inside abrasive wheel 202 is moved away from the cutting blade 46, while the outside abrasive wheel 200 is moved toward the cutting blade 46. In a likewise manner, if the assembly arm 210 is rotated counterclockwise, the inside abrasive wheel 202 is moved toward the cutting blade 46 while the outside abrasive wheel 200 is moved away from the cutting blade 46. This movement of the abrasive wheels 200,202 is used to modify the profile of flanks 246, 248 of blade tip 61 as will be detailed below.

Adjustment of the sharpener is done as follows. If the examination of the blade shows a situation which is similar to that in FIG. 9C, the length of the inside flank 246 must be increased. To do this, the inside abrasive wheel 202 needs adjustment to increase the inside flank 246. To do this, the outside jam nut 256 must be turned clockwise until the dial indicator 260 moves a 0.01 inch increment. Likewise, if the outside flank 248 needs to be lengthened, such as in FIG. 9D, the outside abrasive wheel 200 needs adjustment to lengthen the outside flank 248. To do this, the inside jam nut 258 is turned counterclockwise until the dial indicator 260 moves a 0.001 inch increment. After these adjustments are made, the turning tool 230 is again inserted into the sharpener head shafts 252,254 to determine if either head accepts more force from the air cylinder 234 than the other. This procedure is used to adjust the flanks 246,248 of the flexible band blade tip 61 to provide optimal sharpening of blade 46.

Also shown in FIG. 7 is a blade vibration dampener and lateral blade movement limiter 262. The vibration dampener 262 is used to minimize the vibration of blade 46 when the abrasive wheels 200,202 are in contact with the leading edge of the flexible band blade 46. In normal operation, the vibration dampener 262 is spaced 0.005" from the blade 46. When the blade beings to vibrate, the dampener 262 restricts its lateral movement, which results in a more uniform sharpened surface.

Figure 11:
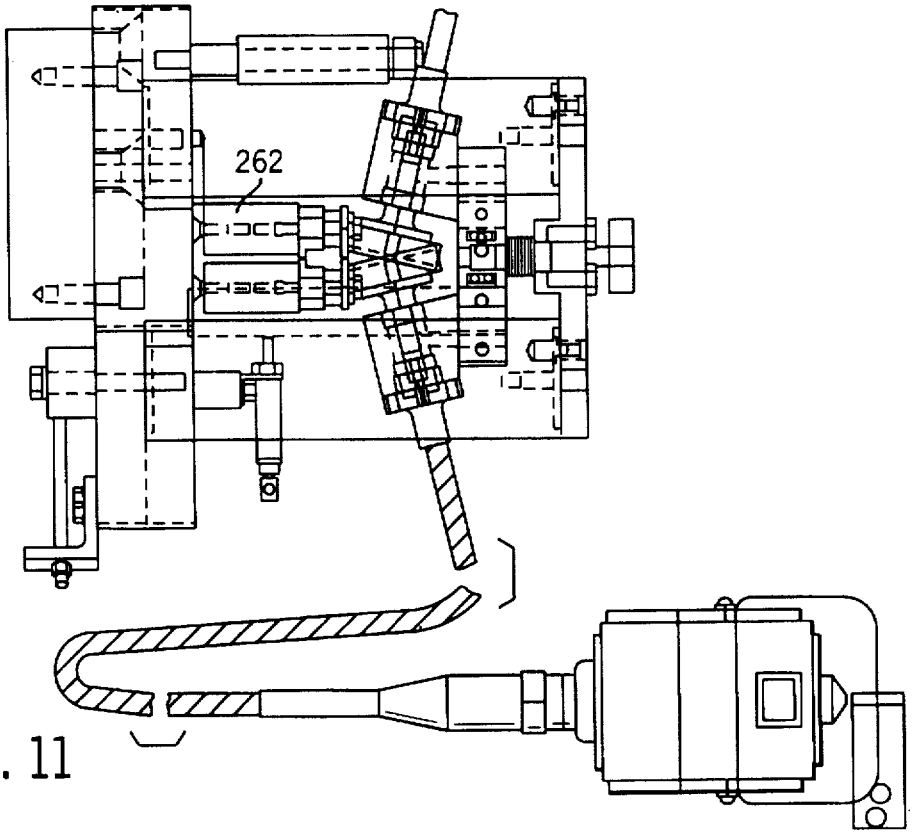
FIG. 11 is an end elevation view of the sharpener assembly and drive motor.
Figure 12:
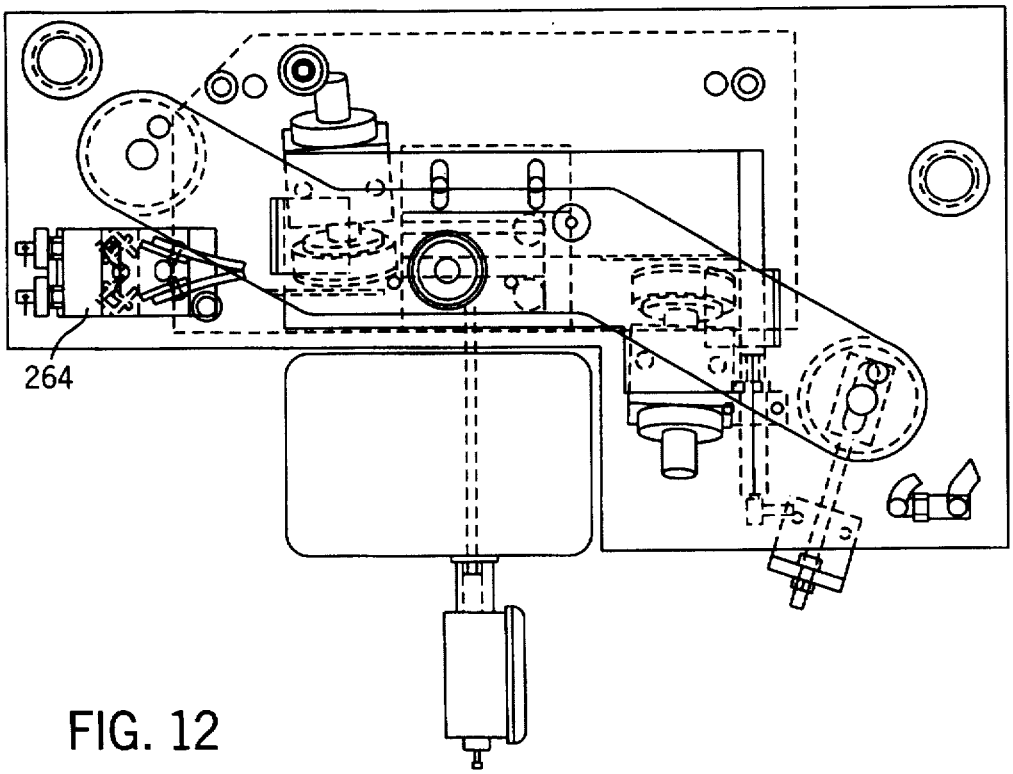
FIG. 12 is an end elevation view of the sharpener assembly including the scraper.
Figure 13:
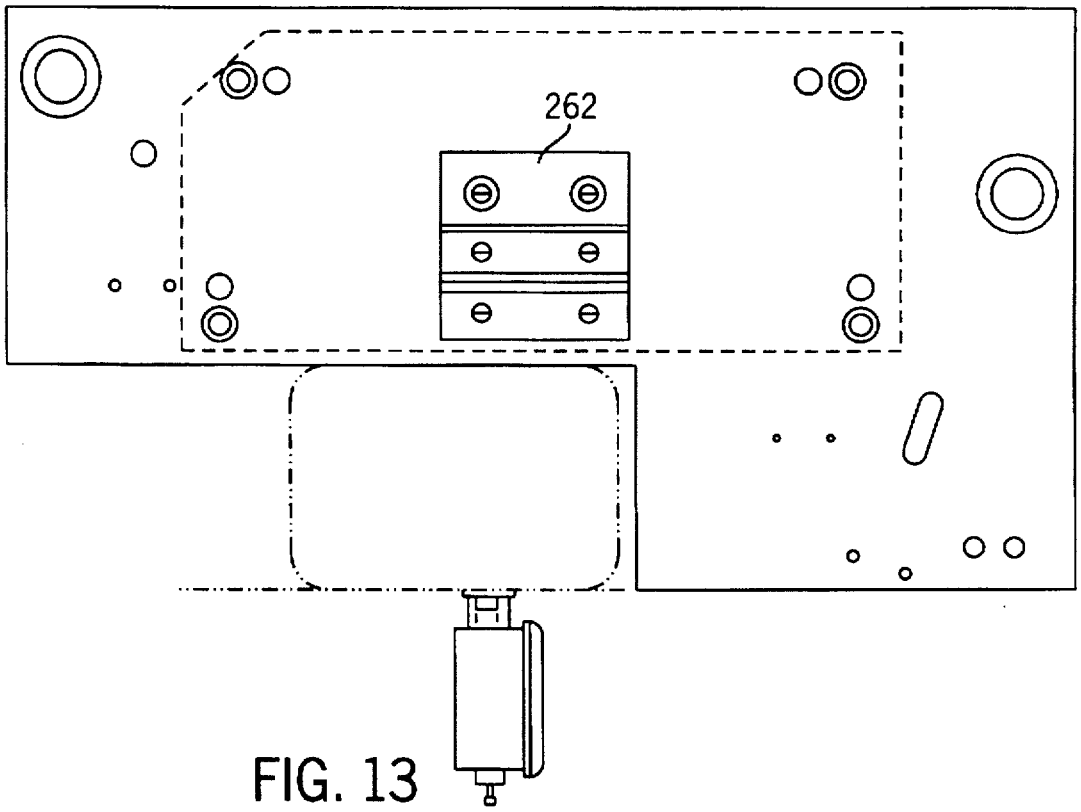
FIG. 13 is an end elevation view of the vibration dampener.
Figure 14:
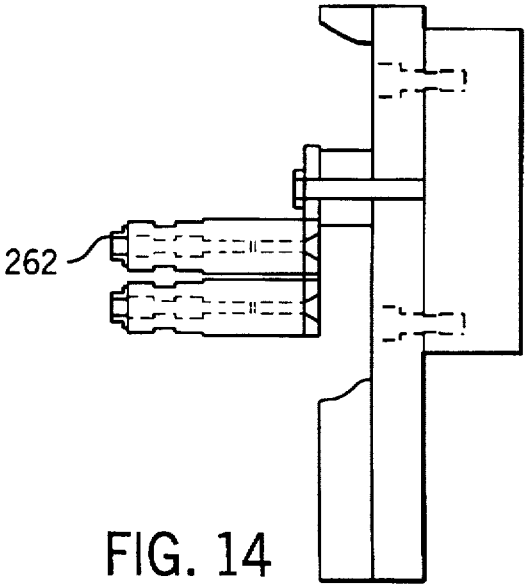
FIG. 14 is a top plan view of the vibration dampener.
Figure 15:
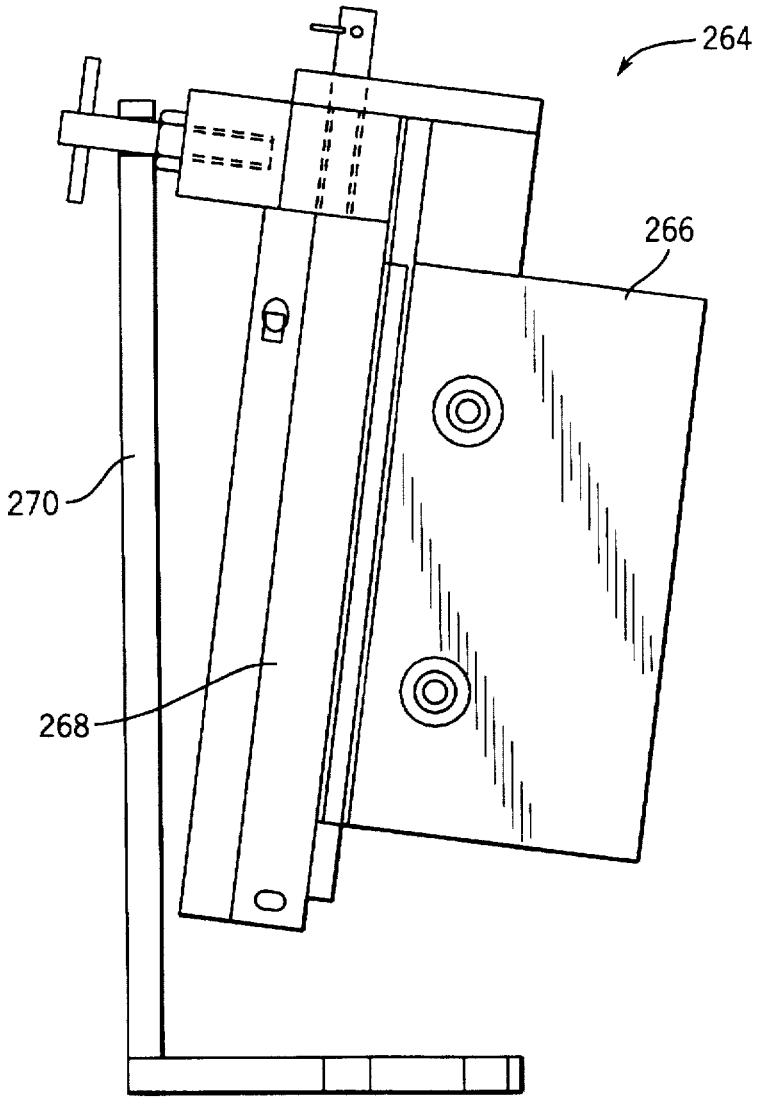
FIG. 15 is a side elevation view of the scraper of the sharpener assembly.

Shown in FIG. 11 is a scraper generally designated 264. The scraper 264 is used to remove debris and metal particles from the cutting blade 46 before it passes through the sharpener 170 of the invention. As is further shown in FIG. 12, the scraper 264 includes a primary scraping means 266 and a secondary scraping means 268. The pairs of flexible scrapers 266,268 are securely mounted on a scraper mounting bracket 270 which is used to position the scraper upstream from the abrasive wheels, as shown in FIG. 11. The scraper 264 is used to remove debris, including metal fragments and portions of the paperboard box from the blade 46 before it contacts the abrasive wheels 200,202. The secondary scraping means 268 are made from a nylon material and are used to remove the largest portions of debris from the cutting blade 46. The primary scraping means 266 are used to remove the smaller portions of debris which remain after the blade 46 passes through the secondary scraping means 268.

We claim:

1. A sharpening device for a continuous flexible band cutting blade having a cutting edge formed by a first and a second side flank, the sharpening device comprising:

a pivot plate pivotally mounted to a pivot point adjacent the cutting edge;

a first rotatable abrasive wheel connected to the pivot plate upstream from the pivot point, the first rotatable abrasive wheel contacting the first side flank;

a second rotatable abrasive wheel connected to the pivot plate downstream from the pivot point, the second rotatable abrasive wheel contacting the second side flank; and a pressure device connected to the pivot plate to selectively rotate the pivot plate about the pivot point such that the first and second abrasive wheels are forced into contact with the cutting blade.

2. The sharpening device of claim 1 wherein the pressure device is an air cylinder.

3. The sharpening device of claim 2 wherein the air cylinder includes a spacer element to modify the amount the air cylinder rotates the pivot plate when activated.

4. The sharpening device of claim 1 further comprising a scrapping device positioned to contact the cutting blade upstream from the first rotatable abrasive wheel.

5. The sharpening device of claim 4 wherein the scrapping device includes a primary and a secondary scrapping means.

6. The sharpening device of claim 5 wherein the secondary scrapping means contacts the cutting blade prior to the contact between the primary scrapping means and the cutting blade.

7. The sharpening device of claim 1 further comprising a blade movement limiter contacting the continuous cutting blade to limit the lateral movement of the cutting blade.

8. The sharpening device of claim 1 further comprising a pair of splashguards, each splashguard being aligned with and positioned on the opposite side of the blade from the first and second abrasive wheels.

9. The sharpening device of claim 1 further comprising a driving means connected to each of the first and second rotatable abrasive wheels, the driving means operable to rotate each of the abrasive wheels.

10. The sharpening device of claim 1 further comprising a source of water applied to the first and second abrasive wheels to lubricate and cool the abrasive wheels.

11. A sharpening device for a continuous flexible band cutting blade having a cutting edge formed by a first and a second side flank, the sharpening device comprising:

a pivot plate Pivotally mounted to a pivot point adjacent the cutting edge;

a first rotatable abrasive wheel connected to the pivot plate upstream from the pivot point, the first rotatable abrasive wheel contacting the first side flank;

a second rotatable abrasive wheel connected to the pivot plate downstream from the pivot point, the second rotatable abrasive wheel contacting the second side flank;

a pressure device connected to the pivot plate to selectively rotate the pivot plate about the pivot point such that the first and second abrasive wheels are forced into contact with the cutting blade; and an assembly arm having an upstream and a downstream end positioned on opposite sides of the cutting blade, the assembly arm connected to the pivot plate at the pivot point such that the pivot plate can pivot with respect to the assembly arm.

12. The sharpening device of claim 11 wherein the upstream end of the assembly arm is fixed and the downstream end of the assembly arm is movable, such that the assembly arm is rotatable about the upstream end.

13. The sharpening device of claim 12 further comprising an adjustment rod securely connected to the downstream end of the assembly arm, the adjustment rod being adjustable to vary the position of the downstream end of the assembly arm.

14. The sharpening device of claim 11 further comprising a bias spring positioned around the pivot point between the pivot plate and the assembly arm.

15. A sharpening device for a continuous flexible band cutting blade having a cutting edge formed by a first and a second side flank, the sharpening device comprising:

an assembly arm having a fixed upstream end and a movable downstream end, the upstream end and the downstream end positioned on opposite sides of the cutting blade;

a pivot plate movably mounted to the assembly arm at a pivot point between the upstream end and the downstream end of the assembly arm;

a first rotatable abrasive wheel connected to the pivot plate upstream from the pivot point, the first rotatable abrasive wheel contacting the first side flank;

a second rotatable abrasive wheel connected to the pivot plate downstream from the pivot point, the second rotatable abrasive wheel contacting the second side flank;

a pressure device connected to the pivot plate to selectively rotate the pivot plate about the pivot point such that the first and second abrasive wheels are forced into contact with the cutting blade; and an adjustment means for moving the downstream end of the assembly arm, the adjustment means being securely connected to the downstream end of the assembly arm.

16. The sharpening device of claim 15 further comprising a bias spring positioned around the pivot point between the pivot plate and the assembly arm.

17. The sharpening device of claim 15 further comprising a scraping device positioned to contact the cutting blade upstream from the first rotatable abrasive wheel.

18. The sharpening device of claim 15 further comprising a blade movement limiter contacting the continuous cutting blade to limit the lateral movement of the cutting blade.

* * * * *